US006475980B2

(12) United States Patent
Bijsterbosch et al.

(10) Patent No.: US 6,475,980 B2
(45) Date of Patent: Nov. 5, 2002

(54) TREATMENT FOR FABRICS

(75) Inventors: Henri Bijsterbosch, Wirral (GB); Deborah Cooke, Wirral (GB); Neil Jones, Wirral (GB); Ezat Khoshdel, Wirral (GB)

(73) Assignee: Unilever Home & Personal Care USA division of Conopco, Greenwich, CT (US)

( * ) Notice: Subject to any disclaimer, the term of this patent is extended or adjusted under 35 U.S.C. 154(b) by 0 days.

(21) Appl. No.: 09/803,701

(22) Filed: Mar. 9, 2001

(65) Prior Publication Data

US 2001/0018411 A1 Aug. 30, 2001

Related U.S. Application Data

(62) Division of application No. 09/409,167, filed on Sep. 30, 1999, now Pat. No. 6,248,710.

(30) Foreign Application Priority Data

Sep. 30, 1998 (GB) ..... 9821218

(51) Int. Cl.[7] ..... C11D 3/382
(52) U.S. Cl. ..... 510/473; 510/474
(58) Field of Search ..... 510/473, 474

(56) References Cited

U.S. PATENT DOCUMENTS 4,668,779 A 5/1987 Brochon et al.
4,853,374 A * 8/1989 Allen ..... 514/57
5,160,641 A 11/1992 Foster
5,540,850 A 7/1996 Foster

FOREIGN PATENT DOCUMENTS

| | | |
|---|---|---|
| EP | 0 093 601 | 11/1984 |
| GB | 948678 | 11/1961 |
| WO | 95/00614 | 1/1995 |
| WO | 95/30042 | 11/1995 |
| WO | 98/00500 | 1/1998 |
| WO | 98/29528 | 7/1998 |
| WO | 99/3469 | 7/1999 |

OTHER PUBLICATIONS

International Search Report.

GB Search Report GB 9821218.6, dated Dec. 21, 1998, 1 page.

* cited by examiner

*Primary Examiner*—John Hardee
(74) *Attorney, Agent, or Firm*—Alan A. Bornstein

(57) ABSTRACT

A water-soluble or water-dispersible material for deposition onto a fabric substrate during a treatment process. The material comprises a $\beta_{1-4}$-linked polysaccharide structure having at least one substituent benefit agent group and optionally, one or more other substituent groups. The average degree of substitution of all substituent groups is from 0.01 to 1.2, preferably from 0.1 to 1.2, more preferably from 0.4 to 1.2. The polysaccharide structure has one or more regions with at least 3, preferably at least 4 consecutive unsubstituted saccharide rings.

18 Claims, No Drawings

TREATMENT FOR FABRICS

This is a division of Ser. No. 09/409,167, filed on Sep. 30, 1999, now U.S. Pat. No. 6,248,710.

TECHNICAL FIELD

The present invention relates to a material comprising a benefit agent and a deposition aid for deposition of the benefit agent onto a fabric. It further relates to a method of depositing a benefit agent from solution or dispersion, onto a fabric.

BACKGROUND OF THE INVENTION

The deposition of a benefit agent onto a fabric is well known in the art. In laundry applications typical "benefit agents" include fabric softeners and conditioners, soil release polymers, sunscreens; and the like. Deposition of a benefit agent is used, for example, in fabric treatment processes such as fabric softening to impart desirable properties to the fabric substrate.

Conventionally the deposition of the benefit agent may rely upon the attractive forces between the oppositely charged substrate and the benefit agent. Typically this requires the addition of benefit agents during the rinsing step of a treatment process so as to avoid adverse effects from other charged chemical species present in the treatment compositions. For example, cationic fabric conditioners are incompatible with anionic surfactants in laundry washing compositions.

Such adverse charge considerations can place severe limitations upon the inclusion of benefit agents in compositions where an active component thereof is of an opposite charge to that of the benefit agent. For example, cotton is negatively charged and thus requires a positively charged benefit agent in order for the benefit agent to be substantive to the cotton, i.e. to have an affinity for the cotton so as to absorb onto it. Often the substantivity of the benefit agent is reduced and/or the deposition rate of the material is reduced because of the presence of incompatible charged species in the compositions.

The deterging nature of laundry wash compositions also places severe limitations upon the inclusion of neutral but hydrophobic or oily benefit agents which are not effectively deposited in the presence of surfactant.

Alternatively, when deposition of a conventional benefit agent is effected by mechanisms that do not rely upon charge interaction but upon other non-covalent forces, for example soil release polymers, other problems may occur, namely where interaction of an anionic surfactant with the benefit agent can also make the material so negatively charged and/or soluble as to overcome the other attractive interactions.

Furthermore, there is frequently another complication in achieving optimum deposition of a benefit agent onto a fabric, in that, the need for solubility of the benefit agent in the medium used to treat the substrate is in principle, incompatible with the requirement for of the benefit agent to deposit/adsorb onto the substrate.

The present invention is directed towards materials for solving one or more of the above problems.

WO-A-98/00500 discloses detergent compositions comprising a peptide or protein deposition aid having a high affinity for fibres or a surface, and a benefit agent attached/adsorbed to the deposition aid. However, the peptide or protein is a relatively expensive material and the need still exists to find a more cost effective alternative material as a vehicle for depositing a benefit agent.

Our unpublished copending European Patent Application No. 98300292.4 discloses polysaccharide or oligosaccharide conjugates with an attached entity (e.g. a protein or an enzyme) having a molecular weight of at least 5,000. Although the poly/oligosaccharide is capable of binding to cellulose, there is no teaching of the molecular requirements for optimising the balance between water solubility and fabric affinity.

GB-A-948 678 discloses a process for dyeing and printing textiles using an aqueous preparation containing organic dyestuff residues linked by a covalent bond to high molecular weight polymers such as cellulose ethers, cellulose derivatives, starches, gums and other related naturally occurring polymers. Cellulose derivatives with a degree of substitution of 0.1 for carboxymethyl substituents are recited explicitly. However, these carboxymethyl groups and the dyestuff residues are not "benefit agent groups" within the sense intended herein.

U.S. Pat. No. 4,668,779 discloses a gel in the form of a complex between a metallic oxide and a semi-synthetic polygalactan. This is described for use in microbiological analysis. There is no disclosure of chemical bonding between a substance and the polysaccharide and certainly no substituent group which is in any way a benefit agent group for conferring a benefit to a fabric.

U.S. Pat. No. 5,160,641 and U.S. Pat. No. 5,540,850 disclose cellulose ether derivatives for use as anti-redeposition agents in fabric washing compositions. Substantially all of the saccharide rings are substituted. Furthermore, there is no mention of substituents which are themselves, benefit agent groups.

WO-A-95/30042 discloses a gel composition for use in the manufacture of treated fabrics. It comprises a cellulose based carrier with a solvent and a material for conferring a speciality finish, e.g. waterproofing, softening or anti-static effect. However, the speciality finish agent is not bonded to the cellulosic gel. Further, there is no disclosure or suggestion of use during washing, rinsing or drying of fabric by a consumer.

WO-A-98/29528 discloses cellulose ethers in which some substituents are (poly)alkoxylated, analogues of the latter in which the (poly)alkoxylated groups are terminated with a cationic moiety in the form of a quaternary ammonium group, and cellulose ethers in which some substituents are carboxylic acids in the salt form (i.e. the materials are essentially carboxymethylcellulose variants). As defined by the general formulae in WO-A-98/129528, none of these molecules has regions of unsubstitution, as required by the present invention.

WO-A-99/14245 discloses laundry detergent compositions containing cellulosic based polymers to provide appearance and integrity benefits to fabrics. These polymers are cellulosic polymers in which the saccharide rings have pendant oxygen atoms to which substituents 'R' can be hydrogen, lower alkyl or alkylene linkages terminated by carboxylic acid, ester or amide groups. Optionally, up to five alkyleneoxy groups may be interspersed between the groups are the respective oxygen atom. WO-A-99/14295 discloses structures analogous to those described in WO-A-99/14245 but in one alternative, the substituents 'R' together with the oxygen on the saccharide ring, constitute pendant half-esters of certain dicarboxylic acids. As described in both of these documents, none of the pendant groups is a benefit agent group.

The present invention relates to materials for achieving initial solubility or dispersibility in the medium used to treat the fabric and effective deposition of one or more benefit-endowing groups thereon.

DEFINITION OF THE INVENTION

Accordingly, a first aspect of the present invention provides a water-soluble or water-dispersible material for deposition onto a fabric substrate during a wash and/or rinse and/or drying process, wherein the material comprises a $\beta_{1-4}$-linked polysaccharide structure having at least one substituent benefit agent group and optionally, one or more other substituent groups, wherein the average degree of substitution of all substituent groups is from 0.01 to 1.2, preferably from 0.1 to 1.2, more preferably from 0.4 to 1.2, the polysaccharide structure having one or more regions with at least 3, preferably at least 4 consecutive unsubstituted saccharide rings.

A second aspect of the present invention also provides a method of depositing a benefit agent onto a fabric by its incorporation in a material according to the first aspect of the invention and applying said material to the fabric.

A third aspect of the present invention also provides compositions comprising a material according to the first aspect of the present invention. In particular, such compositions preferably comprise one or more surfactants.

DETAILED DESCRIPTION OF THE INVENTION

The Material

The material of the present invention is water-soluble or water-dispersible in nature and comprises a $\beta_{1-4}$-linked polysaccharide structure and at least one substituent benefit agent for deposition onto a fabric during a treatment process.

A polysaccharide comprises a plurality of saccharide rings which have pendant hydroxyl groups The benefit agent group(s) and optionally, any other substituent(s) can be bonded chemically to these hydroxyl groups by any means described hereinbelow. The "degree of substitution" means the average number of substituents per saccharide ring for the totality of polysaccharide molecules in the sample and is determined for all saccharide rings whether they form part of a linear backbone or are themselves pendant side groups in the polysaccharide.

Preferably, the substituent benefit agent group(s) is/are attached to the polysaccharide by a hydrolytically stable bond. That means that the bonding of the substituted benefit agent(s) should be sufficiently stable so as not to undergo substantial hydrolysis in the environment of the treatment process for the duration of that process. For example, in laundry cleaning applications, the material should be sufficiently stable so that the bond between the benefit and deposition enhancing part does not undergo hydrolysis in the wash liquor, at the wash temperature, before the benefit agent has been deposited onto the fabric.

Preferably, the bond between the substituent benefit agent (s) and the polysaccharide is such that the decay rate constant ($k_d$) of the material in an aqueous solution at 0.01 wt % of the material together with 0.1 wt % of anionic surfactant at a temperature of 40° C. at a pH of 10.5 is such that $k_d<10^{-3}s^{-1}$.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution.

Deposition onto a substrate includes deposition by adsorption, co-crystallisation, entrapment and/or adhesion.

Polysaccharide

The β-1,4-linked polysaccharide structure is chosen for having an affinity for cellulose, viscose and similar fibres. Suitable such polysaccharides include cellulose, mannan and glucomannan. It may be straight or branched. Many naturally occurring polysaccharides have at least some degree of branching, or at any rate, at least some saccharide rings are in the form of pendant side groups on a main polysaccharide backbone. The polysaccharide may be charged or uncharged, although uncharged types are generally preferred.

The polysaccharide may be a synthetic polysaccharide, a naturally occurring polysaccharide or a modified naturally occurring polysaccharide. Preferably, it has a weight average molecular weight ($M_w$), as determined by GPC, of at least 1,000. In the case of naturally occurring polysaccharides, the $M_w$ range will be typically from 100,000 to 2,000,000. For synthetic or modified naturally occurring materials, the $M_w$ will typically be from 10,000 to 50,000.

Preferably, at least 5% of the saccharide rings are in the consecutive unsubstituted region(s). Most preferably, at least 80% of the unsubstituted region(s) contain no more than 100, especially no more than 50 consecutive unsubstituted saccharide rings. For example, no more than 50% of the saccharide rings are in such regions. Also, for example, no region may have more than 100 (more preferably more than 50) consecutive unsubstituted saccharide rings.

Benefit Agent Group

The benefit agent group may be any group which is used to impart desirable properties to the fabric upon which the material of the present invention is to be deposited. In practice, a material according to the present invention may comprise two or more benefit agent groups on the same molecule, either of the same kind or of different kinds.

Preferably, the benefit agent group(s) is/are selected from any of the following:-

(a) fabric softening and/or conditioning agents;
(b) lubricants for inhibition of fibre damage and/or for colour care and/or for crease reduction and/or for ease of ironing;
(c) UV absorbers such as fluorescers and photofading inhibitors, for example sunscreens/UV inhibitors and/or anti-oxidants;
(d) fungicides and/or insect repellents; and
(e) perfumes.

Suitable fabric softening and/or conditioning agent groups are preferably chosen from those of the cationic detergent active type, and silicones. Those of the cationic detergent active type are preferably selected from quaternary ammonium cationic molecules, for example those having a solubility in water at pH 2.5 and 20° C. of less than 10 g/l.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

As used herein the term 'ester group', when used in the context of a group in the quaternary ammonium material, includes an ester group which is a linking group in the molecule.

Typical are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

It is particularly advantageous if the cationic softening compound is a quaternary ammonium compound with two $C_{12}$–$C_{22}$ alkyl or alkenyl groups connected to a quaternary ammonium group via at least one ester link, preferably two ester links, or else a compound with a single long chain with an average chain length greater than or equal to $C_{20}$. Examples of cationic softeners are described in U.S. Pat. No. 4,137,180 and WO-A-93/23510.

The most preferred type of ester-linked quaternary ammonium material that can be used as benefit agent group(s) is represented by the formula (A):

(A)

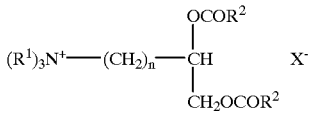

wherein $R^1$, n, $R^2$ and $X^-$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180. Preferably these materials comprise small amounts of the corresponding monoester as described in U.S. Pat. No. 4,137,180 for example 1-hardened tallowoyloxy-2-hydroxy-3-trimethylammonium propane chloride.

Another class of preferred ester-linked quaternary ammonium materials for use as benefit agent group(s) can be represented by the formula:

(B)

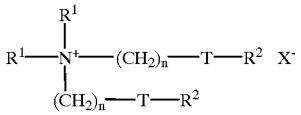

wherein each $R^1$ group is independently selected from $C_{1-4}$alkyl, hydroxyalkyl or $C_{2-4}$ alkenyl groups; and wherein each $R^2$ group is independently selected from $C_{8-28}$ alkyl or alkenyl groups; $X^-$ is any suitable counter-ion, i.e. a halide, acetate or lower alkosulphate ion, such as chloride or methosulphate.

T is 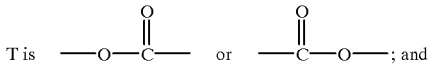 ; and n is an integer from 1–5 or is 0

It is especially preferred that each $R^1$ group is methyl and each n is 2.

Of the compounds of formula (B), Di-(tallowyloxyethyl)-dimethyl ammonium chloride, available from Hoechst, is the most preferred. Di-(hardened tallowyloxyethyl)dimethyl ammonium chloride, ex Hoechst and di-(tallowyloxyethyl)-methyl hydroxyethyl methosulphate are also preferred.

Another preferred class of quaternary ammonium cationic fabric softening agent for use as the benefit agent group(s)is defined by formula (C):-

(C)

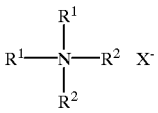

where $R^1$, $R^2$ and X are as hereinbefore defined.

A preferred material of formula (C) is di-hardened tallow-diethyl ammonium chloride, sold under the Trademark Arquad 2HT.

It is also possible to use certain mono-alkyl cationic surfactants which on their own can be used in main-wash compositions for fabrics. Cationic surfactants that may be used include quatenary ammonium salts of the general formula $R_1R_2R_3R_4N^+X^-$) wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

If the fabric softening and/or conditioning group(s) is/are silicones, these may for example be selected from those disclosed in GB-A-1 549 180, EP-A459 821 and EP-A459 822.However, these silicones if used for other benefits listed under the class (b) above, can be regarded as "lubricants". Other suitable lubricants include any of those known for use as dye bath lubricants in the textile industry.

Suitable photofading inhibitors of the sunscreen/UV inhibitor type are preferably molecules with an extinction co-efficient greater than 2000 l $mol^{-1}$ $cm^{-1}$ at a wavelength of maximal absorption. Typically for a sunscreen maximal absorption occurs at wavelengths of 290–370 nm, more usually 310–350 nm, especially 330–350 nm.

Examples of suitable sunscreens are given in *Cosmetic Science and Technology Series,* Vol. 15; Sunscreens; 2nd edition; edited by Lowe, Shoath and Pathak; *Cosmetics and Toiletries;* Vol. 102; March 1987; pages 21–39; and *Evolution of Modern Sunscreen Chemicals;* pages 3–35 both by N. A. Saarth.

In particular, suitable sunscreens include carboxylic acids or carboxylic acid derivatives, for example acrylates, cinnamates and benzoates or derivatives thereof, such as 4-methoxy cinnamate salicylates, PABA, 4-acetoxy benzoate dibenzoylmethanes, phenyl benzoimidazoles, aminobenzoates, benzotriazoles and benzophenones.

Suitable photofading inhibitors of the anti-oxidant type include benzofurans, coumeric acids or derivatives thereof, for example 2-carboxy benzofuran and bis(p-amine sulphonates) triazine, DABCO derivatives, tocopherol derivatives, tertiary amines and aromatic substituted alcohols eg butylated hydroxytoluene (BHT), Vitamin C (ascorbic acid) and vitamin E.

Suitable fungicides include 6-acetoxy-2,4-dimethyl-m-dioxane, diiodomethyl-p-tolysulphone, 4,4-dimethyloxaolidine, hexahydro-1,3,5-tris(2-hydroxyethyl)-s-triazine, sodium dimethyldithiocarbamate, sodium 2-mercaptobenzothioazole, zinc dimethyldithiocarbamate, zinc 2-mercaptobenzothiazole, sodium 2-pyridinethiol-1-oxide, sodium 2-pyridinethiol-1-oxide and N-trichloromethylthio-4-cyclohexene-1,2-dicarboximide.

Suitable insect repellents include N-alkyl neoalkanamides wherein the alkyl is of 1 to 4 carbon atoms and the neoalkanoyl moiety is of 7 to 14 carbon atoms preferably N-methyl neodecanamide; N,N-diethyl meta toluamide (DEET), 2-Hydroxyethyl-n-octyl sulphide (MGK 874); N-Octyl bicycloheptene dicarboximide (MGK 264); hexahydrodibenzofuran (MGK 11), Di-n-propyl isocinchomerate (MGK 326); 2-Ethyl-1,3-hexanediol, 2-(n-butyl)-2-ethyl-1,3-propanediol, dimethyl phthalate, dibutyl succinate, piperonyl butoxide, pyrethrum, Cornmint, Peppermint, American spearmint, Scotch spearmint, Lemon oil, Citronella, cedarwood oil, pine oil, Limonene, carvone, Eucalyptol, Linalool, Gum Camphor, terpineol and fencholic acid.

Suitable perfumes are commercially available and have an undisclosed molecular structure.

Other Substituents

In addition to the benefit agent group(s), the materials according to the present invention optionally may also have one or more other pendant groups. Those are also taken into account when determining the degree of substitution. These may be the same or different and may for example be non-functional groups which are present as artefacts in the naturally occurring material or from the process used to obtain a synthetic or modified naturally occurring material. However, it is possible for one or more of the non-benefit agent pendant groups to be provided for other purposes, e.g. for enhancing the solubility of the molecule. Examples of solubility enhancing substituents include carboxyl, sulphonyl, hydroxyl, (poly)ethyleneoxy- and/or (poly) propyleneoxy-containing groups, as well as amine groups.

The other pendant groups preferably constitute from 0% to 65%, more preferably from 0% to 10% (e.g. from 0% to 5%) of the total number of pendant groups. The minimum number of the other pendant groups may, for example, be 0.1% or 1% of the total. The water-solubilising groups could comprise from 0% to 100% of those other groups but preferably from 0% to 20%, more preferably from 0% to 10%, still more preferably from 0% to 5% of the total number of other pendant groups.

Synthetic Routes

If the benefit is attached to the deposition polysaccharide this may be chemically bonded via a linking agent. However, direct chemical bonding may also be used, as described in more detail hereinbelow.

Suitable linking agents are molecules which show a high affinity for the benefit agent group. It is preferred if the linking agent is covalently attached to the backbone of the deposition enhancing part. It is also advantageous if the linking agent is covalently bound to the benefit agent group.

There are basically two general methods for preparing a water-soluble or water dispersable material comprising a $\beta_{1-4}$-linked polysaccharide and a substituent benefit agent.

According to one such method, the benefit agent(s) is/are grafted onto the polysaccharide.

In a second alternative method, the benefit agent is grafted onto a precursor of the $\beta_{1-4}$-linked polysaccharide; and then the precursor is converted into the desired (modified) polysaccharide.

For both methods, the general method for preparing the polysaccharide may be achieved by a number of different synthetic routes, for example:-

(a) polymerisation of suitable monomers, for example, enzymatic polymerisation of saccharides, e.g. per S. Shoda, & S. Kobayashi, Makromol. Symp. 1995, 99, 179–184 or oligosaccharide synthesis by orthogonal glycosylation e.g. per H. Paulsen, Angew. Chem. Int. Ed. Engl. 1995, 34 1432–1434.;

(b) derivatisation of a polysaccharide chain (either naturally occurring, especially polysaccharides, especially beta-1, 4-linked polysaccharides, especially cellulose, mannan, glucomannan, galactomannan, xyloglucan; or synthetic polymers) up to the required degree of substitution with functional groups, using a reagent (especially acid halides, especially carboxylic acid halides, anhydrides, carboxylic acid anhydrides, carboxylic acids, carbonates) in a solvent which either dissolves the backbone, swells the backbone, or does not swell the backbone but dissolves or swells the product).

(c) hydrolysis of polymer derivatives (especially esters) down to the required degree of substitution; or (d) a combination of any two or more of routes (a)–(c).

Many suitable $\beta_{1-4}$-linked polysaccharides are commercially available.

The degree and pattern of substitution from routes (a) or (c) may be subsequently altered by partial removal of functional groups by hydrolysis or solvolysis or other cleavage. In addition, or alternatively, the degree of polymerisation of the polysaccharide may be reduced before, during, or after the derivatisation with functional groups. For example, the relative proportions of reactants and/or the reaction time can be used to control the degree of substitution. The number of unsubstituted regions may be controlled by choice of the solvent in which the reaction(s) is/are performed, for example exploiting the polarity of the solvent and/or the degree to which reactant are soluble or misable in it (i.e. the degree to which the reaction mixture is homogenous or heterogenous). These techniques and how to apply then will be readily apparent to those skilled in the art of polymer chemistry. The degree of polymerisation of the polysaccharide may be increased by further polymerisation or by cross linking agents before, during, or after the derivatisation step.

For both of the aforementioned methods, grafting the benefit agent onto the polysaccharide can be effected either:-

(a) by physical attraction between the benefit agent and the polysaccharide, especially the use of a block copolymer where one block has a physical affinity for the benefit agent and the other block can undergo a chemical change during treatment which increases its affinity for the fabric; or (b) by grafting the benefit agent onto the polysaccharide using a bond which is relatively hydrolytically stable. For example, an ester bond can be used which is more stable than the one intended to undergo the chemical change but which is not be completely stable. For example a conjugated or aromatic ester. Such grafting can be accomplished by reacting the polysaccharide or already-premodified polymeric backbone (especially cellulose esters, especially cellulose acetates) with a benefit-agent reagent (especially acid halides, especially carboxylic acid halides, anhydrides, carboxylic acid anhydrides, carboxylic acids, isocyanates, triazine derivatives, amines, hydrazines) in a solvent which dissolves the polysaccharide, swells the polysaccharide, or does not swell the polysaccharide (depending on whether grafting the benefit agent first or last) but dissolves or swells the final product.

For the grafting, typically, radiation methods may be used, for example:-

1. Grafting by Mutual Irradiation (The Direct Radiation Grafting of the Benefit Group onto the Polysaccharide).

The mutual irradiation method is the simplest radiation-chemical method for producing graft copolymers. The procedure involves the irradiation of a polymeric substrate in the presence of a benefit group-containing monomer solution, preferably in the absence of oxygen at around ambient temperature for a giving time and irradiation dose. It is known that most radiation-initiated polymerization proceeds by free radical mechanisms, and that it is initiated by the free radicals arising from the radiolysis of the either polymer or monomer, although the mutual irradiation is the most efficient method of achieve grafting.

2. Grafting on to Radiation—Peroxided Polysaccharide.

In this method, the polymeric samples of polysaccharide are first irradiated, typically in the presence of air or pure oxygen atmosphere at around ambient temperature in the absence any monomer or solvent to produce peroxide or hydroperoxides linkages by gamma irradiation. Subsequently, the graft copolymerization is initiated by the free radicals produced from the thermal decomposition of peroxide or hydroperoxides linkages under heating with a benefit agent monomer in the appropriate solvent.

Two different situations arise, depending on whether peroxides or hydroperoxides are formed in the irradiated polymer. Either, the peroxidation leads to peroxidized polymer or else it leads to hydroperoxides.

Grafting may also be effected by means of chemical grafting, for example using ceric ions (A. Habeish et al, J. Appl. Polym. Sci. 1971,15, 11–24) or using other conventional radical initiators such as potassium persulphate, e.g. per R. K. Samal, et al J. Polym. Mater. 1987, 4(3), 165–172.

In one example hereinbelow there is described a method of producing carboxymethyl cellulose with grafted fluorescer groups. There are a number of ways one can introduce fluorescent molecules onto carboxymethylcellulose. Generally most fluorescent molecules contain an amine functionality. A simple method will be the amidation of these two molecules. If desired a water soluble coupling agent can also be employed.

Another method will be via a linking group such as cyanuric chloride (2,4,6-trichloro-1,3,5-triazine) as shown below. This can be conducted by reacting SCMC with cyanuric chloride, followed by reaction with the fluorescent molecule. The reaction sequences can also be altered, i.e. reacting the fluorescent molecule with cyanuric chloride first and then reacting the adduct with SCMC. As fluorescent molecules are sensitive to light, the reaction is best to be carried out with a blacked out apparatus.

Compositions

The material according to the first aspect of the present invention may be incorporated into compositions containing only a diluent (which may comprise solid and/or liquid) and/or also comprising an active ingredient. The compound is typically included in said compositions at levels of from 0.01% to 25% by weight, preferably from 0.5% to 20%, most preferably from 1% to 15%.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 Wt %, more preferably 1 wt % to 25 wt %, most preferably from 2 wt % to 15 wt %.

The compositions of the invention may contain other anionic surfactants in amounts additional to the percentages quoted above. Suitable anionic surfactants are well-known to those skilled in the art. Examples include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of non-ionic surfactant is from 0 wt % to 30 wt %, preferably from 1 wt % to 25 wt %, most preferably from 2 wt % to 15 wt %.

Cationic surfactants can also be used for fabric softening and/or rinse conditioning. These may for example be of the type mentioned hereinbefore for use as benefit agent groups.

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio, optionally together with soap.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: $0.8–1.5Na_2O.Al_2O_3.0.8–6SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. No. 4,751,015 and U.S. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. No. 4,686,063 and U.S. 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention.

Examples of suitable proteolytic enzymes are the subtilins which are obtained from particular strains of *B. Subtilis B. licheniformis,* such as the commercially available subtilisins Maxatase (Trade Mark), as supplied by Gist Brocades N.V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; soil release polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive. However, many of these ingredients will be better delivered as benefit agent groups in materials according to the first aspect of the invention.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Treatment

The treatment of the fabric with the material of the invention can be made by any suitable method such as washing, soaking or rinsing of the fabric.

Typically the treatment will involve a washing or rinsing method such as treatment in the main wash or rinse cycle of a washing machine and involves contacting the fabric with an aqueous medium comprising the material of the invention.

The present invention will now be explained in more detail by reference to the following non-limiting examples:-

EXAMPLE 1

Preparation of Carboxymethyl Cellulose with Pendant Fluorescer Groups

Carboxymethylcellulose (medium viscosity) (2 g) was dissolved in water (100 ml) and the pH of the solution was adjusted to 5. Then in a blacked out apparatus, cyanuric chloride (1 g) was added dropwise at 5° C. over a slow stream of nitrogen. The reaction mixture was stirred for one hour at this temperature. It was then allowed to rise to ambient temperature and then an aqueous suspension of 4—4'-bis[4-amino-6-(4-carboxyethylanilino)-s-triazine-2-yl)amino]2,2'-stilbenedisulphonic acid disodium salt (a fluorescent molecule) (0.2 g) was added dropwise over 5 minutes period. After the addition was complete, the temperature was raised to 40° C. and the reaction mixture was stirred overnight at this temperature. The reaction product was transferred to a blacked out crystallising dish and freeze dried. This produced a fluorescent functionalised SCMC.

This material was found by analysis to have a degree of substitution and regions of consecutive ring unsubstitution within claim 1.

EXAMPLE 2

Preparation of Guar Gum with Pendant UV Absorber Groups 2 g Guar gum was dissolved in 1 liter of rapidly stirred hot distilled water. The solution was allowed to cool to room temperature. 0.01 g sodium periodate in 50 ml distilled water as added to the guar gum solution and stirred for 72 hours.

100 ml of the oxidised guar gum solution was acidified to pH 6 and 0.2 gram p-nitrophenyl hydrazine (a UV absorber) in 5ml methanol in was added. The solution was stirred for 48 hours.

Precipitating the aqueous solution into ethanol purified the polymer. The precipitate was filtered off and re-dissolved in distilled water without drying. This process was repeated three times. The purified polymer was dissolved in distilled water and the solid content determined. The level of p-nitrophenyl hydrazine was determined by UV/vis spectroscopy.

This material was found by analysis to have a degree of substitution and regions of consecutive ring unsubstitution within claim 1.

EXAMPLE 3

Performance Evaluation—Deposition onto White Cotton

A stock solution comprising of 0.05 g surfactant, 0.02 g (1.86% tag) of the substituted polymer of Example 1 was made up to 100 ml using 0.01M sodium bicarbonate. Three systems were evaluated, 100% LAS, 75% LAS/25% Synperonic A7 and when no surfactant was used.

Mercerised white cotton (1 gram) was washed in 10ml stock solution at 40° C for 30 minutes. After the wash period, excess liquor was removed by spin-drying. The amount of tagged polymer in solution after washing determined by UV/vis spectroscopy at 390 nm using the stock solution as reference.

The following Table shows that build up of the polymer milligrams per gram of cotton fabric over a number of wash cycles.

| Number of washes | 100% LAS | 75% LAS/ 25% A7 | No surfactant |
|---|---|---|---|
| | mg polymer per gram cotton | | |
| 0 | 0 | 0 | 0 |
| 1 | 0.016 | −0.005 | 0.485 |
| 2 | 0.13 | 0.187 | 0.745 |
| 3 | 0.162 | 0.277 | 0.855 |
| 4 | 0.23 | 0.497 | 1.049 |
| 5 | 0.457 | 0.722 | 1.068 |

The composition examples 4–15, were each prepared in two variants, the "Polymer" being either the product of Example 1 or the product of Example 2.

EXAMPLE 4

Spray-Dried Powder

| Component | % w/w |
|---|---|
| Na PAS | 11.5 |
| Dobanol 25-7 | 6.3 |
| Soap | 2.0 |
| Zeolite | 24.1 |
| SCMC | 0.6 |
| Na Citrate | 10.6 |
| Na Carbonate | 23.0 |
| Polymer | 4.0 |

-continued

| Component | % w/w |
|---|---|
| Silicone Oil | 0.5 |
| Dequest 2066 | 0.4 |
| Sokalan CP5 | 0.9 |
| Savinase 16L | 0.7 |
| Lipolase | 0.1 |
| Perfume | 0.4 |
| Water/salts | to 100 |

EXAMPLE 5

Detergent Granulate Prepared by Non-Spray Drying Method

The following composition was prepared by the two-stage mechanical granulation method described in EP-A-367 339.

| Component | % w/w |
|---|---|
| Na PAS | 13.5 |
| Dobanol 25-7 | 2.5 |
| STPP | 45.3 |
| Na Carbonate | 4.0 |
| Polymer | 3.8 |
| Na Silicate | 10.1 |
| Minors | 1.5 |
| Water | balance |

EXAMPLE 6

Isotropic Laundry Liquid

| Component | % w/w |
|---|---|
| Na-citrate (37.5%) | 10.7 |
| Propyleneglycol | 7.5 |
| Ethylene Glycol | 4.5 |
| Borax | 3.0 |
| Savinase 16L | 0.3 |
| Lipolase | 0.1 |
| Polymer | 3.5 |
| Monoethanolamine | 0.5 |
| Cocofatty acid | 1.7 |
| NaOH (50%) | 2.2 |
| LAS | 10.3 |
| Dobanol 25-7 | 6.3 |
| LES | 7.6 |
| Minors | 1.3 |
| (adjust pH to 7 with NaOH) | |
| Water | up to 100 |

EXAMPLE 7

Structured Laundry Liquid

| Component | % w/w |
|---|---|
| LAS | 16.5 |
| Dobanol 25-7 | 9 |
| Oleic acid (Priolene 6907) | 4.5 |
| Zeolite | 15 |
| KOH, neutralisation of acids and pH to 8.5 | |
| Citric acid | 8.2 |
| deflocculating polymer | 1 |
| Protease | 0.38 |
| Lipolase | 0.2 |
| Polymer | 2.0 |
| Minors | 0.4 |
| Water | to 100% |

| Component | % w/w | | | | | | | |
|---|---|---|---|---|---|---|---|---|
| | Ex. 8 | Ex. 9 | Ex. 10 | Ex. 11 | Ex. 12 | Ex. 13 | Ex. 14 | Ex. 15 |
| Na alcohol EO sulphate | 0.0 | 0.0 | 0.0 | 0.0 | 0.0 | 0.0 | 0.0 | 13.3 |
| linear alkylbenzenesulfonate, Na salt (LAS) | 5.1 | 5.9 | 5.8 | 7.3 | 8.2 | 9.9 | 23.7 | 7.6 |
| sodium stearate | 0.0 | 0.3 | 0.3 | 0.3 | 1.0 | 1.2 | 0.0 | 0.0 |
| fatty acid | 1.7 | 0.3 | 0.3 | 0.4 | 0.0 | 0.0 | 0.0 | 0.0 |
| alcohol ethoxylate 9EO | 0.0 | 0.0 | 0.0 | 0.0 | 0.0 | 0.0 | 0.0 | 7.6 |
| alcohol ethoxylate 7EO branched | 2.5 | 3.9 | 3.9 | 4.8 | 4.3 | 5.2 | 0.0 | 0.0 |
| alcohol ethoxylate 3EO branched | 3.4 | 2.9 | 2.9 | 3.6 | 2.3 | 2.8 | 0.0 | 0.0 |
| sodium citrate | 0.0 | 0.0 | 0.0 | 0.0 | 3.3 | 7.4 | 0.0 | 4.8 |
| propylene glycol | 0.0 | 0.0 | 0.0 | 0.0 | 0.0 | 0.0 | 0.0 | 6.4 |
| sorbitol | 0.0 | 0.0 | 0.0 | 0.0 | 0.0 | 0.0 | 0.0 | 4.3 |
| sodium borate | 0.0 | 0.0 | 0.0 | 0.0 | 0.0 | 0.0 | 0.0 | 2.9 |
| sodium silicate | 0.4 | 5.9 | 5.8 | 7.3 | 1.5 | 0.0 | 7.9 | 0.0 |
| sodium carbonate | 17.6 | 9.0 | 12.0 | 12.4 | 9.2 | 17.5 | 17.3 | 0.0 |
| sodium bicarbonate | 0.0 | 0.0 | 0.0 | 6.1 | 0.9 | 3.8 | 0.0 | 0.0 |
| sodium sulphate | 19.8 | 16.2 | 13.9 | 16.3 | 0.0 | 0.0 | 26.1 | 0.0 |
| STPP | 0.0 | 22.1 | 22.1 | 27.4 | 0.0 | 0.0 | 14.3 | 0.0 |
| zeolite A24 (anhydrous) | 19.8 | 0.0 | 0.0 | 0.0 | 28.0 | 33.8 | 0.0 | 0.0 |
| sodium perborate tetrahydrate | 11.7 | 17.9 | 17.8 | 0.0 | 0.0 | 0.0 | 0.0 | 0.0 |
| coated percarbonate 13.5 avOx | 0.0 | 0.0 | 0.0 | 0.0 | 18.0 | 0.0 | 0.0 | 0.0 |
| TAED granule (83%) | 2.1 | 2.0 | 2.0 | 0.0 | 5.2 | 0.0 | 0.0 | 0.0 |
| minors | 5.9 | 3.8 | 3.2 | 4.2 | 8.0 | 8.3 | 0.8 | 1.2 |
| water | 0.0 | 0.0 | 0.0 | 0.0 | 0.0 | 0.0 | 0.0 | 46.9 |
| polymer | 10.0 | 10.0 | 10.0 | 10.0 | 10.0 | 10.0 | 10.0 | 5.0 |
| TOTAL: | 100.0 | 100.0 | 100.0 | 100.0 | 100.0 | 100.0 | 100.0 | 100.0 |

Raw Material Specification

| Component | Specification |
|---|---|
| Polymer | The material of Example 1 |
| LAS | Linear Alkyl Benzene Sulphonic-acid, Marlon AS3, ex Huls |
| Na-LAS | LAS-acid neutralised with NaOH |
| Dobanol 25-7 | C12-15 ethoxylated alcohol, 7EO, ex Shell |
| LES | Lauryl Ether Sulphate, Dobanol 25-S3, ex Shell |
| Zeolite | Wessalith P, ex Degussa |
| STPP | Sodium Tri PolyPhosphate, Thermphos NW, ex Hoechst |
| Dequest 2066 | Metal chelating agent, ex Monsanto |
| Silicone oil | Antifoam, DB 100, ex Dow Corning |
| Tinopal CBS-X | Fluorescer, ex Ciba-Geigy |
| Lipolase | Type 100L, ex Novo |
| Savinase 16L | Protease, ex Novo |
| Sokalan CP5 | Acrylic/Meleic Builder Polymer ex BASF |
| Deflocculating Polymer | Polymer A-l-l disclosed in EP-A- 346 995 |
| SCMC | Sodium Carboxymethyl Cellulose |

What is claimed is:

1. A water-soluble or water-dispersible material for deposition onto a fabric substrate during a wash, rinse, and drying process, wherein the material comprises a $\beta_{1-4}$-linked polysaccharide structure having at least one substitutent benefit agent group, wherein the average degree of substitution of all substitutent groups is from 0.1 to 1.2, the polysaccharide structure having one or more regions with at least 3 consecutive unsubstituted saccharide rings; and wherein the benefit agent group is selected from:

(a) fabric softening and conditioning agents;

(b) lubricants;

(c) fungicides, insect repellents and insecticides; and (d) perfumes.

2. The material of claim 1 wherein the average degree of substitution for all substituent groups is from 0.4 to 1.2.

3. The material of claim 1 wherein the polysaccharide structure has one or more regions with at least 4 consecutive unsubstituted saccaharide rings.

4. The material of claim 1, wherein at least 5% of the saccharide rings are in said consecutive unsubstituted region(s).

5. The material of claim 1, wherein no more than 50% of the saccharide rings are in said consecutive unsubstituted regions.

6. The material of claim 1, wherein at least 80% of said unsubstituted regions have no more than 100 consectutive unsubstituted saccharide rings.

7. The material of claim 1, wherein at least 80% if said unsubstituted regions have no more than 50 consecutive unsubstituted saccharide rings.

8. The material of claim 1, wherein from 0% to 65% of the number of total pendant groups are other than benefit agent groups.

9. The material of claim 1, wherein from 0% to 10% of the number of total pendant groups other than benefit agent groups.

10. The material of claim 9, wherein from 0% to 20% of the other groups are water solubilizing groups.

11. The material of claim 9, wherein from 0% to 10% of the other groups are water-solubilizing groups.

12. The material of claim 9, wherein from 0% to 5% of the other groups are water-solubilizing groups.

13. A composition comprising the material of claim 1 and at least one further component.

14. The composition of claim 13, in which the further component comprises a surfactant.

15. The composition of claim 13, comprising from 0.01% to 25% by weight of the material of claim 1.

16. The composition of claim 15 comprising from 0.5% to 20% by weight of the material of claim 1.

17. The composition of claim 13 comprising from 1% to 15% by weight of the material of claim 1.

18. A method of depositing a benefit agent onto a fabric substrate by:

(a) preparing a liquor comprising the material of claim 1; and (b) treating the substrate with said liquor.

* * * * *